United States Patent [19]

Fischer et al.

[11] Patent Number: 4,498,393

[45] Date of Patent: Feb. 12, 1985

[54] PROCESS FOR THE DISTRIBUTION OF SUBMUNITION

[75] Inventors: Klaus Fischer, Troisdorf; Heinz Kroschel, Troisdorf-Sieglar; Joachim Nicodemus, Cologne; Willi Petters, Leverkusen, all of Fed. Rep. of Germany

[73] Assignee: Dynamit Nobel Aktiengesellschaft, Troisdorf, Fed. Rep. of Germany

[21] Appl. No.: 360,788

[22] Filed: Mar. 22, 1982

[30] Foreign Application Priority Data

Mar. 26, 1981 [DE] Fed. Rep. of Germany ..... 3111907

[51] Int. Cl.[3] ..... F42B 13/50; F42B 25/16

[52] U.S. Cl. ..... 102/393; 102/387; 102/489

[58] Field of Search ..... 102/387, 394, 393, 401, 102/489, 505, 337, 338, 340, 351, 357

[56] References Cited

U.S. PATENT DOCUMENTS 1,365,865 1/1921 Svejda ..... 102/340

3,113,752 12/1963 Brestel ..... 102/340

4,333,400 6/1982 McNelia et al. ..... 102/387

4,372,215 2/1983 Crepin ..... 102/387

*Primary Examiner*—Charles T. Jordan

*Attorney, Agent, or Firm*—Antonelli, Terry & Wands

[57] ABSTRACT

Minimum probability of collision during the dispensing procedure is desirable in the distribution of submunition, such as mines, bomblets, or subsidiary projectiles by means of rockets or shells.

For this purpose, a dual ejection process is provided wherein the individual submunitions are accommodated severally in special dispensing units which units, in turn, are inserted as secondary elements in the rockets or shells. Upon primary ejection over the target area, the dispensing units are ejected, stabilized at a distance from the rockets or shells, and subjected to a deceleration different from that of the rockets or shells so that the flight paths diverge, thus precluding collision. Subsequently, in a secondary ejection, the submunition is ejected from the dispensing units.

9 Claims, 4 Drawing Figures

PROCESS FOR THE DISTRIBUTION OF SUBMUNITION

The invention relates to a process for the distribution of submunition wherein individual submunitions accommodated within at least one dispersing unit or element of a carrier projectile; e.g., rocket or shell, are released at a predetermined point in time or space, by a dual ejection procedure.

The dispensing of submunition by means of carrier projectiles is generally known. The submunition can involve mines, bomblets, subsidiary projectiles (mini-missiles), interference units, or the like. Especially suitable as the carrier projectile are rockets, but shells, for example, can also be used. In previous technical solutions, the warheads of the carrier rockets or the shells are generally disintegrated over the target area in various ways, and all individual elements or individual submunitions are directly released at this time.

The requirements to be met by the various types of submunition from tactical and technical viewpoints, which have become increasingly higher in recent years, resulted in ever more complex designs with electronic systems and electromechanical sensors. These submunitions are perforce more trouble-prone with regard to mechanical stresses as they occur in the conventional dispensing methods.

It is furthermore known from DOS [German Unexamined Laid-Open Application] No. 2,153,994 to arrange submunition or, in a more general sense, ejection elements, in the warhead of a rocket; this warhead being equipped with a special dispensing unit. This dispensing unit exhibits a payload carrier plate with several ejection tubes pivotably mounted thereto and containing the ejection elements; these tubes are spread apart prior to dispensing. In order to achieve a circular distribution of the ejected elements on the ground, the dispensing unit can be decelerated in flight prior to release of the ejection elements by additional braking measures, for example, by a braking parachute or by brake flaps, so that the unit drops vertically downwardly. In this connection, the dispensing unit can still be joined to the remainder of the rocket, or it can be separated therefrom and brought into the vertical trajectory by itself.

However, it has been found that this method is not as yet adequate, for obtaining a distribution which is satisfactory in all cases. If the entire carrier projectile is braked, an undesirably high effort is required for the braking measures. If the dispensing unit is separated from the remainder of the projectile, then, as has been discovered, collisions can occur between the two components; i.e., the projectile and the unit, during the course of the continued movement of the components, preventing the defined release of the submunition or ejection elements and leading to undesirable additional stresses. As a consequence, the submunition can be impaired in its functional reliability.

The invention is based on the object of avoiding, in particular, the aforedescribed disadvantages; i.e., of conducting a process for the dispensing of submunition so that collisions and other undesirable stresses and thus a reduction in functional reliability of the submunition are at least extensively precluded.

This object has been attained by the process of this invention wherein the at least one dispensing unit is ejected from the carrier projectile by being guided during the ejection movement, the carrier, is maintained in a stable flight position spaced from the projectile and is decelerated differently from the projectile so that the trajectories of the carrier projectile and the dispensing unit diverge and, thereafter, the individual submunitions are ejected from the at least one dispensing unit. By the defined ejection according to this invention, of one or several dispensing units from the carrier projectile after reaching the ballistically determined point of disintegration over the target area, such a large distance is created between the dispensing units and the remaining part of the carrier projectile that collisions between the dispensing unts and the carrier projectile and ensuing disturbances in the distribution of the submunition on the ground are reliably avoided. The ejection of the dispensing unit takes place preferably in the flight direction of the carrier projectile. A defined guidance during the ejection movement can be attained, for example, by guiding the dispensing units, designed as cylindrical or tubular members, in corresponding, tubular ejection devices of the carrier projectile in the manner of a shell. In this connection, the dispensing units can be ejected from single tubes or also from ejection tubes wherein the units are respectively arranged severally in series and/or side-by-side relationship, optionally by way of sabots. Also guide means in the manner of launching rails are possible.

The dispensing units are each equipped with aerodynamic stabilizing means, for example, guide vanes to avoid undefined flight motions. The at least one dispensing unit and the remainder of the carrier projectile, initially moving along the same trajectory at a mutual distance, are then subjected to a different ballistic deceleration. For example, if the remainder of the carrier projectile exhibits a very much smaller mass than the dispensing unit, then the carrier projectile, on account of this fact alone, can be sufficiently strongly braked to a greater extent than the dispensing unit and thus be deflected downwardly from its original flight path. However, preferably the provision is made that the dispensing unit is equipped with a braking device which simultaneously has a stabilizing effect, so that the dispensing unit is more strongly decelerated and thereby deflected downwardly, and the carrier projectile flies over the dispensing unit extensively on the ballistic track of the original projectile. In this connection, the distance of the dispensing unit from the carrier projectile, produced by the defined primary ejection from the carrier projectile, and braking of each are adapted to each other in such a way that the dispensing unit, while again approaching the carrier projectile on account of the braking action, yet remains at a spacing from the carrier projectile which is adequate; i.e., which prevents collisions. Subsequently, the individual elements of the submunition can be ejected from the dispensing unit and thus released in a secondary ejection for individual distribution. In this way, possible collisions of the remaining parts of the carrier projectile with the dispensing unit and also with the submunition are precluded, and reproducible ballistic relationships are achieved.

By the primary and secondary ejections, also called dual ejection according to this invention, still further advantages are attained in case of heavier carrier units; i.e., projectiles having a relatively large number of individual submunitions; these advantages will be explained in greater detail hereinafter.

With the conventional distribution methods, bases on the individual instance of firing, an accidental distribution of the individual submunitions on the ground is achieved which, in case of a small number of individual elements, approaches equipartition and, in case of a larger number of individual elements, approaches Gaussian distribution.

If the carrier projectiles are fired in series under identical firing (launching) conditions, then a Gaussian distribution is also obtained for the carrier ammunition, superimposed by the accidental distribution based on the individual instance of firing. This superposition fails to yield an optimum area coverage in case of a large number of individual elements of a carrier unit, since two Gaussian distributions are superimposed one on the other. Such optimum area coverage is generally attained only if the individual members of the submunition based on one carrier unit are distributed in an almost equal fashion.

According to the invention, in case of heavier carrier units, the individual submunitions are accommodated in several dispensing units arranged as secondary elements in the carrier projectile in side-by-side and/or series relationship. Their number is small as related to the total number of individual members per carrier unit. Thereby, during primary ejection, in accordance with the static laws, approximately a uniform distribution of the dispensing units per carrier projectile is achieved with an expansion corresponding to the ejection height. If, now, the number of individual elements per dispensing unit is likewise small, then a more or less perfect equipartition is attained even during secondary ejection, based on the individual dispensing unit. Since the second ejection point is lower than the first, the less expansive equipartition of the individuals per dispensing units is superimposed upon the equipartition of the dispensing units in an advantageous fashion, resulting in an equipartition [uniform distribution] of all individual elements of a carrier projectile.

In carrier projectiles having a relatively large number of individual submunitions, the conventional distribution methods, with a direct release of the submunition from the carrier projectile, result moreover in a piling up [accumulation] of the individual elements at the point of release. Thereby the probability of collision of individual elements with one another and with parts of the disintegrated carrier projectile is substantially increased. Also this disadvantage is avoided if the submunition is accommodated in several dispensing units, the number of which is correspondingly lower as compared with the number of individual elements.

The individual submunitions are arranged in the dispensing unit preferably in the manner of a stack or column in series. They are furthermore inserted in the dispensing unit, in dependence on the ejection direction from the dispensing unit, preferably in an oriented fashion so that, after their ejection, the submunitions need, for example, no longer tumble to assume their intended position during flight. This secondary ejection from the dispensing unit can take place in the flight direction of the unit. However, preferably, the individual submunitions are ejected from the dispensing unit against the flying or flight direction of the unit, or they are, so to speak, peeled off in the forward direction. During this step, the dispensing unit is additionally accelerated in the flight direction; whereas the submunition elements are decelerated. On account of the fact that the dispensing unit, as compared with the submunition, is generally very much smaller in mass, the velocity of the dispensing unit is greatly increased; accordingly, here again a marked distance is produced between the dispensing unit and the submunition. Due to the subsequent, differing ballistic deceleration, the trajectories of the two components; i.e., the unit and the submunition then diverge in such a way that even in the further course of the dispensing procedure, no danger of collision exists.

A further disadvantage of the distributing methods known heretofore resides in that upon release of the submunition excessively high flying velocities prevail generally immediately thereafter. The concomitant mechanical stresses occurring in a shock-like fashion during release can lead to endangering of the electronic and electromechanical components of modern submunition and accordingly can still further restrict their functional reliability additionally to the danger of collisions. In accordance with a further proposal by the invention, the provision is, therefore, made that the dispensing units prior to the secondary ejection are braked to such an extent that the submunition can be ejected without any danger of damage by the stresses occurring due to the pressure head of the air flow.

The dual ejection according to this invention furthermore offers the possibility in case of carrier projectiles flying at supersonic speed to obtain an optimum deceleration of the dispensing unit, on the one hand, and the individual submunitions, on the other hand, by decelerating the dispensing unit, for example, with a braking parachute designed for supersonic speed; whereas the individual members, i.e., submunitions, are decerated; for example, with the use of braking parachutes designed for subsonic speeds, so that they do not exceed a prescribed impact velocity on the ground. Consequently, a controlled impact on the ground is furthermore achieved with corresponding, defined stress directions, for which the submunition can be designed. The accidental distribution of the individual submunitions can be spread over a relatively large area depending on the requirements, for instance, by asymmetrical openings in the braking parachutes.

The progression of the process of this invention is illustrated by way of example in the drawings in four different phases and will be explained in greater detail below with reference thereto wherein FIG. 1 is a schematic view showing the relative positions of the carrier projectile, the dispensing element and the nose portion of the projectile just after initial ejection;

Figure 1:
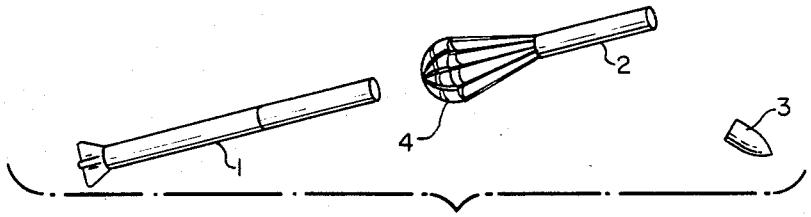

In FIG. 1, the primary ejection is shown after the carrier projectile 1 with the tubular dispensing unit 2 containing the submunition has reached the ballistically determined point of ejection above the target area. The ejection of the dispensing unit 2 takes place after an ignition pulse [impulse] from a time fuse or a proximity fuse responding to the distance from the ground, by means of a pyrotechnical ejection charge. The ogive 3 is blasted away previously or simultaneously with the ejection. The dispensing unit 2, stabilized by means of the supersonic parachute 4 and moving like the carrier projectile 1 along a defined trajectory, is shown directly after the ejection step; i.e., still in the close proximity of the carrier projectile 1.

Figure 2:
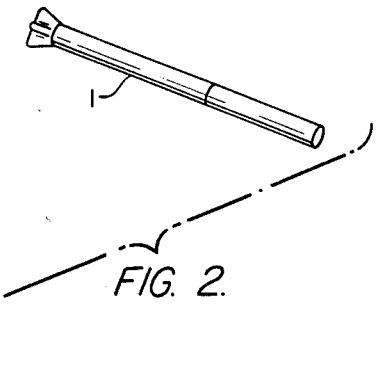
FIG. 2 is a schematic view of the relative positions of the carrier projectile and the dispensing element has entered into its own trajectory.
Figure 2:
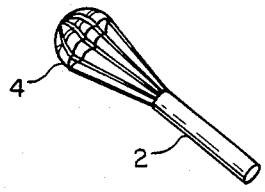

During the course of further movement, the spacing between the two components; i.e., the unit and the projectile. is initially enlarged until the decelerating effect of the parachute 4 predominates and the dispensing unit 2 swings, according to FIG. 2, into its own trajectory. The remainder of the carrier projectile 1 flies over the dispensing unit at an adequate distance so that collisions are precluded.

Figure 3:
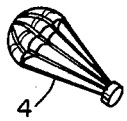
FIG. 3 is a schematic view of the dispensing element and the submunition at the time of secondary ejection; and, FIG. 4 is a schematic view of the relative portions of the submunition during descent to the ground.
Figure 3:
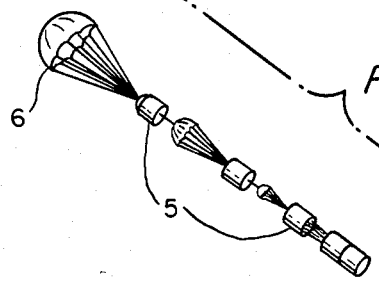

FIG. 3 shows the secondary ejection after the dispensing unit 2 has been decelerated to subsonic speed. The submunition, here five mines 5, is ejected after the elapse of a predetermined delay time from the primary ejection, again with the aid of a pyrotechnical charge, from the dispensing unit 2; i.e., from case 2'', sealed at its front end 2', against the flight direction. The time delay can be effected by a pyrotechnical, mechanical, or electronic means. During this procedure, the braking parachute 4 is likewise separated.

Figure 4:
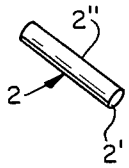
Figure 4:
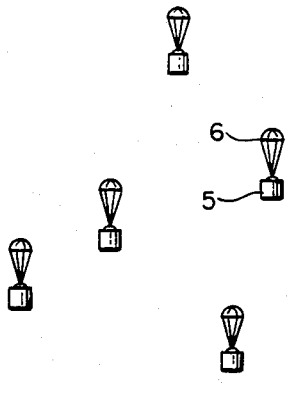

The mines 5, arranged as a dense stack in the dispensing case 2'', with their subsonic parachute 6 are separated by the vigorous, successively occurring braking action and finally float to the ground according to FIG. 4 stabilized and braked in an approximately uniform distribution. The distribution of the mines 5 on the ground can be influenced by asymmetries at the braking devices 6 and by the elevation or altitude existing at secondary ejection.

The distance between the carrier projectile and the dispensing unit to be maintained depends on the velocity of the carrier projectile. Generally the distance should be between approximately (0.02 and 0.2)s$\times V_c$, whereby $V_c$ means the velocity of the carrier projectile at the moment of ejection in m/s. In practice this distance is determined by the dimensioning of the ejection charge in the carrier projectile, which effects the ejection of the dispensing unit out of the carrier projectile.

The maximum velocity which can be withstood by the submunition depends on the construction of the submunition, especially the braking or stabilizing device of it. If e.g. a rather expensive supersonic parachute is used the velocity at the moment of ejection out of the dispensing unit can also be supersonic. Preferred, however, is the ejection with subsonic velocity. If the submunition is not ejected in the direction of air flow of the dispensing unit the withstandable velocity of submunition with a parachute has to be far below Mach 1, preferably below 200 m/s. This is achieved by a corresponding deceleration unit for the dispensing unit.

What is claimed is:

1. A process for the distribution of submunition wherein a plurality of individual submunitions completely accommodated within at least one dispensing unit of a carrier projectile are released at a predetermined point in time, characterized in that the at least one dispensing unit is ejected in a defined fashion at a predetermined instant from the carrier projectile by being guided during the ejection movement in the carrier projectile, and is maintained in a stable flight position at a spacing from the carrier projectile; and that the carrier projectile and the at least one dispensing unit are differently decelerated so that the trajectories of the carrier projectile and the at least one dispensing unit diverge, and finally the plurality of individual submunitions which are completely accommodated within the at least one dispensing unit are ejected from the at least one dispensing unit.

2. A process according to claim 1, wherein each submunition is ejected from the at least one dispensing unit against the flight direction of the at least one dispensing unit.

3. A process according to claim 1 or claim 2, wherein each submunition is ejected only when the at least one dispensing unit has been braked to a velocity which can be withstood by the submunition.

4. A process according to claim 3, wherein the at least one dispensing unit prior to ejection of the submunition is decelerated to preferably subsonic speed with the aid of a braking device for the supersonic range.

5. A process for the distribution of submunition wherein a plurality of individual submunitions accommodated in at least one dispensing unit of a carrier projectile are released at a predetermined point in time, characterized in that the at least one dispensing unit is ejected in a defined fashion at a predetermined instant from the carrier projectile by being guided during the ejection movement in the carrier projectile, and is maintained in a stable flight position at a spacing from the carrier projectile; and that the carrier projectile and the at least one dispensing unit are differently decelerated so that the trajectories of the carrier projectile and the at least one dispensing unit diverge, and finally the plurality of individual submunitions are ejected from the at least one dispensing unit, wherein the at least one dispensing unit is ejected from the carrier projectile so as to maintain a predetermined spacing therefrom in accordance with the relationship of (0.02 to 0.2)s$\times V_c$, where $V_c$ is the velocity of the carrier projectile at the moment of ejection in m/s.

6. A process according to claim 5, wherein an ejection charge is provided in the carrier projectile for ejecting the at least one dispensing unit from the carrier projectile, the ejection charge being dimensioned so as to enable the maintenance of the predetermined separation between the carrier projectile and the at least one dispensing unit.

7. A process according to claim 1 or claim 5, wherein the ejection of the at least one dispensing unit from the carrier projectile and the ejection of the plurality of individual submunitions from the at least one dispensing unit are arranged so that the trajectories of the carrier projectile, the at least one dispensing unit and the individual submunitions diverge from one another, whereby collisions between the individual submunitions and the at least one dispensing unit and the carrier projectile are avoided and reproducible ballistic relationships for the individual submunitions are achieved so as to provide an even distribution of the individual submunitions in a target area.

8. A process according to claim 7, wherein the carrier projectile carries a plurality of dispensing units, each of the dispensing unit accommodating a plurality of individual submunitions, each of the dispensing units being ejected in a defined fashion at a predetermined instant from the carrier projectile by being guided during the ejection movement in this carrier projectile, and being maintained in a stable flight position at a spacing from the carrier projectile, the carrier projectile and the plurality of dispensing units being differently decelerated so that the trajectories of the carrier projectile and the plurality of dispensing units diverge, and finally the plurality of individual submunitions are ejected from the respective dispensing units.

9. A process according to claim 3, wherein the at least one dispensing unit at the time of ejection from the carrier projectile is moving at supersonic speed, and the at least one dispensing unit prior to ejection of the submunition is decelerated to subsonic speed with the aid of a braking device for the supersonic range.

* * * * *